US005299495A

United States Patent [19]

Schoeps et al.

[11] Patent Number: 5,299,495

[45] Date of Patent: Apr. 5, 1994

[54] CYLINDER MOISTENING ASSEMBLY

[75] Inventors: Martin H. Schoeps; Georg Schneider, both of Würzburg; Kurt J. Weschenfelder, Zell a. Main, all of Fed. Rep. of Germany

[73] Assignee: Koenig & Bauer Aktiengesellschaft, Wurzburg, Fed. Rep. of Germany

[21] Appl. No.: 914,575

[22] Filed: Jul. 20, 1992

[30] Foreign Application Priority Data

Jul. 27, 1991 [DE] Fed. Rep. of Germany ..... 4125012

[51] Int. Cl.[5] ..... B41L 25/00

[52] U.S. Cl. ..... 101/147; 101/366; 101/425

[58] Field of Search ..... 101/147, 148, 366, 425, 101/424; 118/301, 313, 315; 239/DIG. 23, 462, 505, 507, 512, 513, 520

[56] References Cited

U.S. PATENT DOCUMENTS

| | | | |
|---|---|---|---|
| 2,389,730 | 11/1945 | Iler | 101/147 |
| 2,543,663 | 2/1951 | Marsden | 101/147 |
| 2,995,084 | 8/1961 | Mosegaard | 101/147 |
| 3,926,115 | 12/1975 | Alsop | 101/148 |
| 4,034,670 | 7/1977 | Zovodny | 101/148 |
| 4,044,673 | 8/1977 | Junghans | 101/148 |
| 4,044,674 | 12/1975 | Smith, Jr. | 101/148 |
| 4,469,024 | 9/1984 | Schwartz et al. | 101/147 |
| 4,530,285 | 7/1985 | Fischer | 101/365 |
| 4,831,927 | 5/1989 | Lin | 101/148 |
| 5,040,457 | 8/1991 | Lin | 101/147 |
| 5,092,242 | 3/1992 | Knauer | 101/181 X |

FOREIGN PATENT DOCUMENTS

| | | | |
|---|---|---|---|
| 0931228 | 8/1955 | Fed. Rep. of Germany | 101/147 |
| 2439999 | 8/1974 | Fed. Rep. of Germany . | |
| 2462162 | 8/1974 | Fed. Rep. of Germany . | |
| 2658875 | 12/1976 | Fed. Rep. of Germany . | |
| 2931579 | 8/1979 | Fed. Rep. of Germany . | |
| 1055391 | 5/1952 | France | 101/147 |
| 2207810 | 11/1973 | France . | |
| 59-159345 | 3/1983 | Japan . | |

*Primary Examiner*—Edgar S. Burr
*Assistant Examiner*—Christopher A. Bennett
*Attorney, Agent, or Firm*—Jones, Tullar & Cooper

[57] ABSTRACT

A cylinder moistening assembly which is usable to apply moistening fluid to the surface of a cylinder utilizes a plurality of axially spaced fan spray nozzle devices in a housing. A screen assembly having upper and lower screen plates which define a spray outline or aperture is positioned intermediate a spray nozzle of the fan spray nozzle device and the cylinder. A smooth spray of moistening fluid is applied to the cylinder in a uniform manner particularly in those areas where the spray patterns of adjacent nozzles overlap.

9 Claims, 5 Drawing Sheets

CYLINDER MOISTENING ASSEMBLY

FIELD OF THE INVENTION

The present invention is directed generally to a cylinder moistening assembly. More particularly, the present invention is directed to a device for moistening cylinders of offset rotary printing presses. Most specifically, the present invention is directed to a cylinder moistening assembly which uses a plurality of fan spray nozzle devices. The fan spray nozzle devices are positioned adjacent each other axially along the cylinder to be moistened. A screen assembly is interposed between each fan spray nozzle device and the cylinder to be moistened to provide a spray outline through which the liquid spray from the spray nozzles must pass. The spray outline may be smooth or irregular and one or both of the screen plates that form the screen assembly may be movable to vary the size of the spray outline.

DESCRIPTION OF THE PRIOR ART

It is generally known in the art to spray a moistening fluid, such as water or the like, onto the surfaces of cylinders in offset rotary printing presses. A typical way of accomplishing this spraying of a moistening fluid is shown in U.S. Pat. No. 4,044,674. In this prior art device there are provided a plurality of fan spray nozzles which are placed adjacent each other axially along the cylinder to be sprayed. A limitation of this type of an arrangement is an unequal distribution of the sprayed water or other moistening fluid in the axial direction of the cylinder. This is due to the overlap of the spray patterns of adjacent nozzles, particularly at the edges of the spray areas. Such an unequal distribution of the moistening spray will result in irregularities in the image printed by the offset rotary printing press.

In German Letters Patent No. 2,931,579 there is shown a screen device which is adjustable over the width of the printing forme of an offset rotary printing press. This is used in a device for the central adjustment of the moistening agent guidance so as to be able to meter the amount of emerging moistening agent in accordance with the speed of the press. The U.S. firm Ryco sells a moistening system of this type. In this prior art device there is again a problem with an overlap of the spray patterns of the fan spray nozzles which causes variations in the quality of the printed images. An uneven distribution of moisture is immediately visible in the printed image and particularly with respect to color printed surfaces. Assuming that an ideal constant moisture distribution factor is 1.0, there may well be variations between 0.6 and 1.5 over the surface of the cylinder being moistened. These variations are a function of the location on the cylinder with respect to the extended centerline of the spray nozzle. Thus the area at the center of the nozzle as compared to the area at approximately 70° from the centerline of the nozzle, where the sprays from adjacent nozzles overlap will show this variance in moisture distribution.

The prior art moistening fluid spray nozzles are susceptible of becoming partially blocked or clogged. The ink mist generated by the rotating cylinders, or the presence of paper dust can cause this nozzle blockage or clogging and a resultant loss or reduction of the functioning of the effected nozzle. Faulty nozzle operations result in a non-uniform spray pattern.

An alternative approach to a device for providing a mist of moistening fluid to moisten the cylinders of an offset rotary printing press is shown in German unexamined patent application No. DE-OS 26 58 875. In this device, particles of moisture are generated by use of high-pressure, moisture-atomizing nozzles that blow into a chamber. These moisture particles are then transferred to the moisture application roller or to the plate cylinder through an adjustable slit by means of an air stream that is generated by a cross-flow blower. Even though this prior art device uses an adjustable slit through which the mixture of moisture particles and air is supplied to the moisture application roller or the plate cylinder, there is still only an indirect supply of the moisture mixture. This is because there is no direct contact of the flow of moisture particles generated by the atomizing nozzle with the surface of the plate cylinder. Because of this indirect application of the moisture particles to the plate cylinder, the mixture of moisture mist and air does not have sufficient energy to penetrate the vortices of air that surround the rotary cylinder. Accordingly, the mixture of moisture and air does not become transferred to the cylinder. A significant additional limitation of this device is its high cost.

It will thus be seen that a need exists for an apparatus which will supply a uniform, continuous spray of a moistening fluid to a cylinder surface. The cylinder moistening assembly of the present invention provides such an apparatus and is a significant improvement over the prior art devices.

SUMMARY OF THE INVENTION

It is an object of the present invention to provide a cylinder moistening assembly.

Another object of the present invention is to provide an assembly for moistening cylinders of an offset rotary printing press.

A further object of the present invention is to provide a cylinder moistening assembly which uses a plurality of fan spray nozzle devices.

Yet another object of the present invention is to provide a cylinder moistening assembly having a plurality of axially spaced fan spray nozzle devices.

Still a further object of the present invention is to provide a cylinder moistening assembly which provides a uniform distribution of moistening agent over the surface of the cylinder being moistened.

Even yet another object of the present invention is to provide a cylinder moistening assembly having a plurality of screen assemblies which define moistening fluid spray outlines.

As will be discussed in detail in the description of the preferred embodiments which is set forth subsequently, the cylinder moistening assembly of the present invention utilizes a plurality of fan spray nozzle devices which are positioned adjacent each other axially along the length of a cylinder to be moistened. A screen assembly is interposed between each moistening fluid spray nozzle and the cylinder itself. The screen assembly includes upper and lower screen plates which define a spray outline through which the spray of moistening fluid passes. The spray outline can have any one of a number of desired shapes so that the surface of the cylinder being moistened will receive a uniform spray of the moistening fluid. The spray nozzles themselves may be mounted for pivotal motion in either or both the horizontal and vertical directions so that the spray of moistening fluid will be evenly applied.

A primary advantage of the cylinder moistening assembly of the present invention is its ability to provide a virtually uniform moisture distribution factor per unit of surface area of the cylinder being moistened. By using fan spray nozzle devices which spray moistening fluid directly onto the cylinder and by disposing the nozzle devices behind a screen assembly with a controllable spray outline, an approximately equal amount of moistening agent per unit of surface area is achieved. This is the situation even in areas where the sprays from two adjacent nozzles overlap. This uniformity of moistening fluid application insures constant print quality, even during changes of the printing speed.

The cylinder moistening assembly of the present invention also provides a smoothed, high energy spray that is directed toward the surface of the rotating cylinder to be moistened with sufficient force to penetrate the envelope of air that surrounds the rotating cylinder during operation of the cylinder. This also results in an even and complete moistening of the cylinder.

The fan spray nozzle devices of the cylinder moistening assembly of the present invention are disposed in housings which are maintained at a positive pressure by the use of compressed air. This positive pressure in the housings insures that ink mist and paper dust will not enter the spray nozzles and thus cannot block or clog the nozzles. Accordingly, the total or partial breakdown of nozzle operation, as is the case in prior art devices, is eliminated in the present invention. In addition, each spray nozzle or spray nozzle pair is provided with a slidable temporary cover which can be used to cover nozzles not in use if, for example, only portions of the entire printing width are being used. These slidable temporary covers will also prevent ink mist or paper dust from blocking or clogging the nozzles. Even if one or more of the spray nozzles should become partially clogged or blocked, the spray outline defined by the upper and lower screen plates of the screen assembly will insure that a better distribution of the moistening fluid occurs than would be the result if the screen assembly were not present.

The cylinder moistening assembly of the present invention overcomes the limitations of the prior art devices. It provides a uniform, even distribution of moistening fluid in a manner which is a substantial advance in the art.

BRIEF DESCRIPTION OF THE DRAWINGS

While the patentable features of the cylinder moistening assembly in accordance with the present invention are set forth with particularity in the appended claims, a full and complete understanding of the invention may be had by referring to the detailed description of the preferred embodiments which is presented subsequently, and as illustrated in the accompanying drawings in which:

DESCRIPTION OF THE PREFERRED EMBODIMENT

Figure 1:
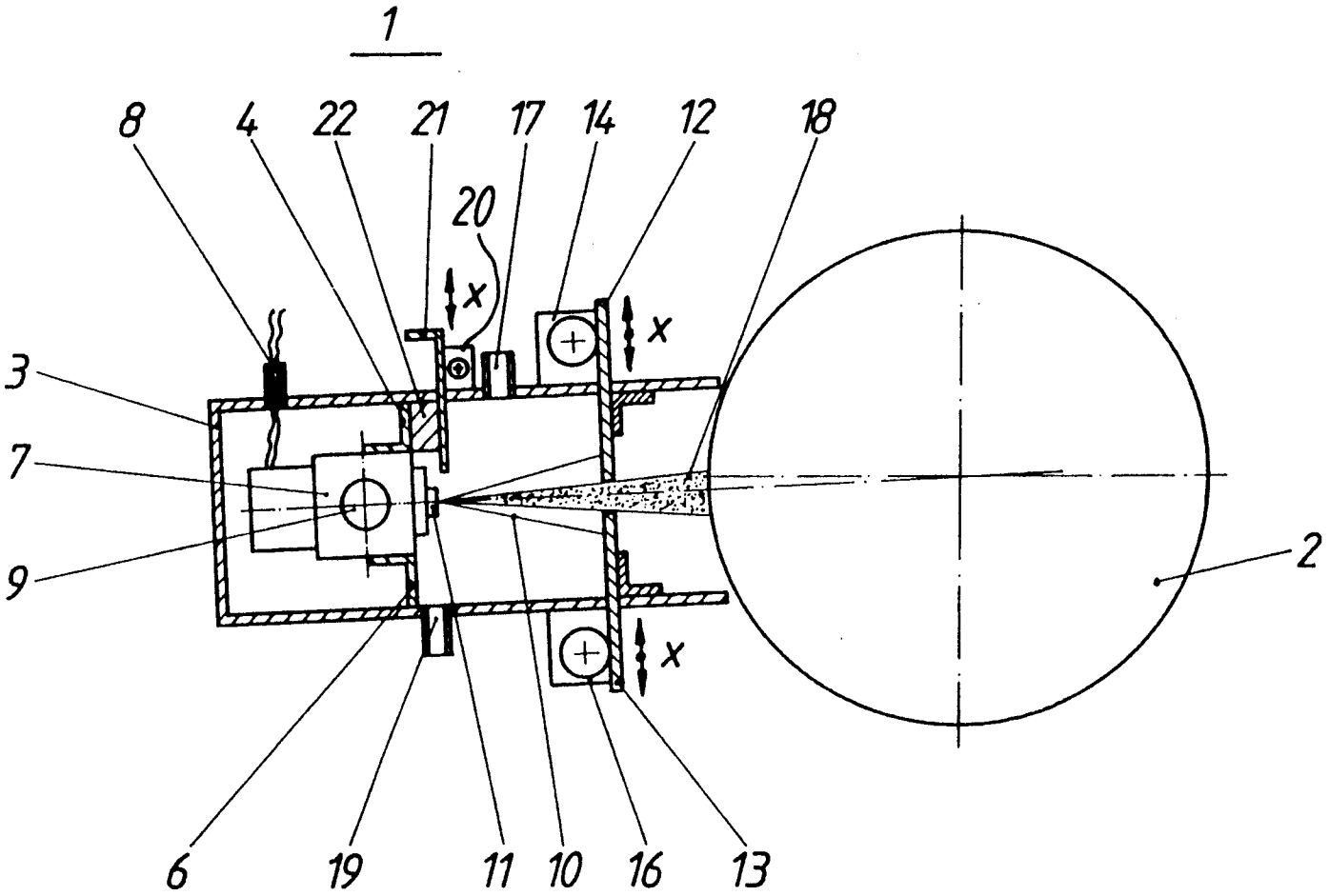
FIG. 1 is a cross-sectional view of a cylinder moistening assembly in accordance with the present invention.

Referring initially to FIG. 1, there may be seen generally at 1 a first preferred embodiment of a cylinder moistening assembly in accordance with the present invention. The cylinder moistening assembly, generally at 1, is used to apply a moistening fluid, such as water, to the surface of a cylinder 2 of an offset rotary printing press which is not specifically shown in the drawings.

A plurality of fan spray nozzle devices 7 are carried in a housing or housings 3 and are attached to suitable support members 4 and 6 which are part of the housing 3. The housing 3 is generally U-shaped in cross-section, as may be seen in FIG. 1. It will be understood that housing 3 can be attached to the printing press frame in any suitable manner which is not specifically depicted in the drawings.

Each of the plurality of the fan spray nozzle devices 7 are disposed axially next to each other, with, for example, eight of them being provided for the entire length of the cylinder 2 to be printed. Each of the fan spray nozzle devices 7 has a connection 8 to an electric control, not shown, and to a moistening agent supply 9. Each fan spray nozzle device 7 has a spray nozzle 11 through which a spray 10 of fluid is directed through an open side of the U-shaped housing 3 to the surface of the cylinder 2. A two-piece screen assembly 15 with upper and lower plates 12 and 13 is located between each of the nozzles 11 and the surface of the cylinder 2. Each of the upper and lower screen plates 12 and 13 can be moved vertically in the direction indicated by the arrows "X" as shown in FIG. 1. Movement of the screen plates can be accomplished by suitable servo motors 14 and 16. These servo motors 14 and 16 could be provided with suitable hydraulic, pneumatic or electrical drives, as desired. While not specifically depicted, it will be understood that the servo motors 14 and 16 could be provided with an adjustment assembly which could include a toothed wheel that would engage a toothed rack that would be attached to the screen plates 12 and 13. It would also be possible to provide manual adjusting assemblies for the upper and lower screen plates 12 and 13 and to eliminate the servo motors 14 and 16.

The housing 3 has a compressed air supply line 17 for use in providing compressed air in the range from 1.1 to 1.5 bar to the interior of housing 3. The moistening fluid spray 10 impacts as a smoothed spray 18 on the screen plates 12 and 13, which are opened to a larger or lesser degree, depending on the amount of water needed. The smoothed spray 18 that passes between the screen plates 12 and 13 strikes the surface of the turning cylinder 2. The unused moistening agent flowing back from the screen plates 12 and 13 on the inside of the housing is returned through a drain 19 into the moistening agent circuit, not shown. The drain 19 is located on the lowest point of the housing 3. This can be accomplished by setting the housing 3 at an angle, as indicated in FIG. 1, or the bottom plate of the housing 3 can have an inclination so that the return flow of the moistening agent is directed to the drain 19.

As may also be seen in FIG. 1, a slide 21, which is movable in the direction of the arrow X, is also provided in the housing 3 and can cover the nozzles 11 to protect them from contamination when they are not in use. In each case a pair of nozzles 11 is covered, depending on the printing width required. The slide 21 is disposed on a guide 22 and can be operated manually or by a motor 20. In the case of a motor drive, it would be possible to attach a conventional toothed wheel on the shaft of the motor 20, which engages the slide 21 through a toothed rack.

Figure 2:
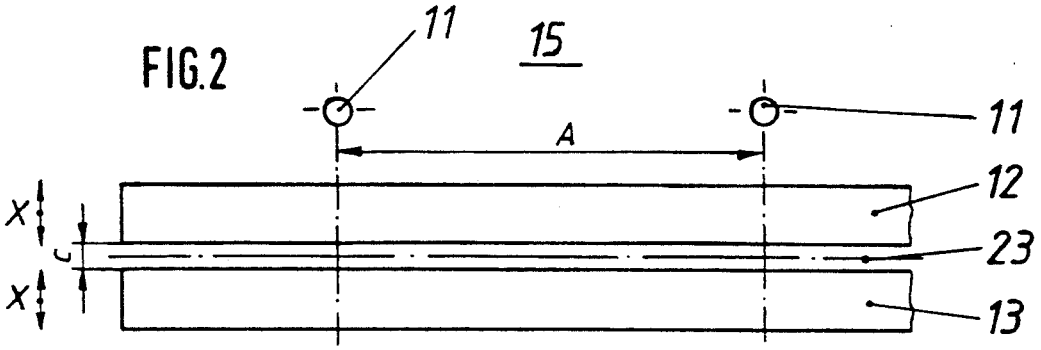
FIG. 2 is a front view of a first screen assembly usable in the present invention.
Figure 3:
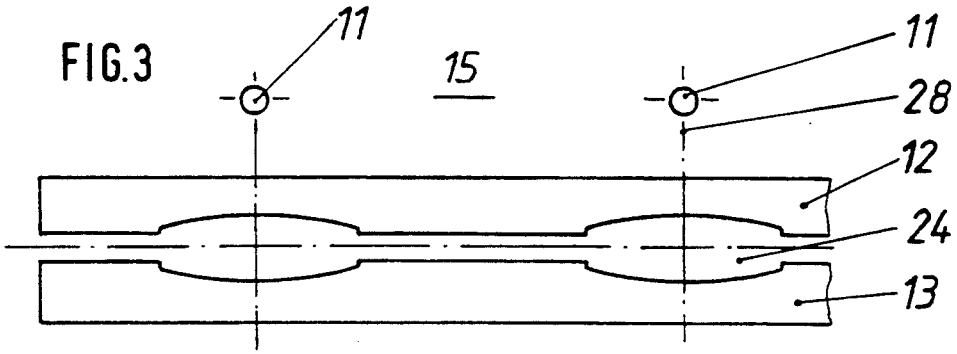
FIG. 3 is a front view of a second screen assembly.
Figure 4:
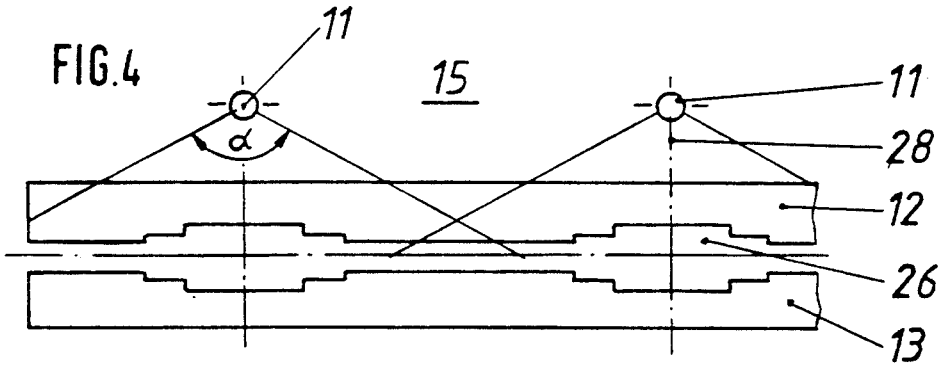
FIG. 4 is a front view of a third screen assembly.
Figure 5:
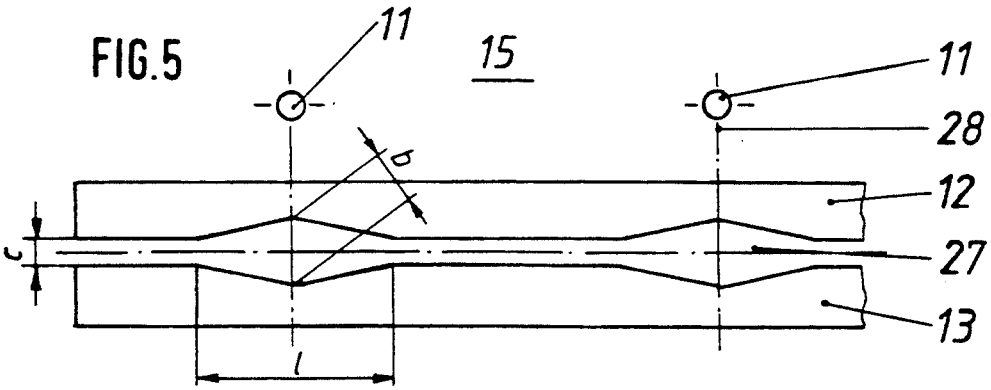
FIG. 5 is a front view of a fourth screen assembly.
Figure 6:
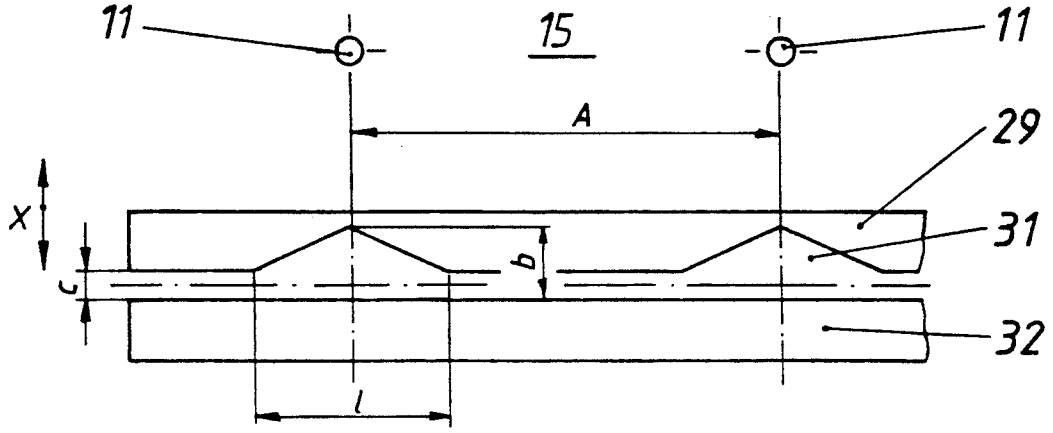
FIG. 6 is a front view of a fifth screen assembly.

Turning now to FIGS. 2–6 there may be seen several exemplary embodiments of screen outlines that are provided by the shapes of, and spacings between the upper and lower screen plates 12 and 13. In each of these embodiments, a pair of spaced spray nozzles are depicted at 11 with these two spray nozzles being spaced from each other at a distance "A". As was discussed previously, each of the screen plates 12 and 13, which comprise the screen assembly, are movable in the vertical direction "X". In FIG. 2, there is shown a smooth, uniform spray outline or spray aperture 23. A somewhat segmented second spray outline 24 is shown in FIG. 3 while FIG. 4 shows a third spray outline 26 which rises and falls in steps. In FIG. 5, there is shown a fourth triangular spray outline or aperture 27 in which both of the upper and lower screen plates 12 and 13 have spaced cut-outs. In the partial front view of a fifth, semi-triangular spray outline 31 which is depicted in FIG. 6, the upper screen plate 29 has a triangular outline or cut-out 31 and is movable in the direction indicated by arrow X. The lower screen plate 32 is held stationary. A minimum width "C" of this spray outline or aperture 31 is located between the parallel positions of the screen plates 29 and 32.

In accordance with the present invention, and as depicted in FIGS. 2–6 a smooth spray outline is defined as one which is uniform along its entire length. An orderly spray outline has periodically changing cut-outs in the screen plate. An irregular spray outline has cut-outs of various shapes. In the segmental outline 24 depicted in FIG. 3, the cut-outs could be semi-circular in shape. As identified specifically in FIG. 5, "b" denotes the width of the relief, "r" is the length of the relief and "c" is the minimum width between the screen plates. The spray angle of each spray nozzle is denoted as $\alpha$ in FIG. 4 and areas of spray overlap are indicated at "a" in FIG. 7 which will be discussed shortly. In the preferred embodiment of the cylinder moistening assembly of the present invention, the length "l" of the relief can be 0.16 to 0.6 times the distance "A" between the adjacent nozzles 11. The width "b" can be 0.05 to 0.15 times the distance "A" between adjacent nozzles 11. The minimum width "c" can be 0.01 to 0.1 times the distance "A" between the nozzles 11. Furthermore, the spray angle $\alpha$ of the spray nozzles 11 can be between 40° and 150°.

The operation of the cylinder moistening assembly, generally at 1, in accordance with the present invention will now be discussed. Referring initially to FIG. 1, a spray 10 of moistening fluid extends in the direction of the cylinder 2 through the nozzle 11 of the fan spray nozzle device 7. The spray 10 is smoothed by means of the placement of the screen plates 12, 13, which are movable in the direction of the arrow X in accordance with the amount of water needed, and is evenly distributed in accordance with the alternative use of the outlines 23 to 27, so that the spray 10 leaves the screen plates 12 and 13 as a smoothed and evenly distributed spray 18 and strikes the cylinder 2. The moistening agent running off when the spray 10 impacts on the screen plates 12 and 13 is returned to the moistening agent circuit through the drain 19 and is then returned to the moistening agent supply 9. The overpressure in the housing 3, as supplied by the compressed air line 17, keeps ink mist or paper dust from penetrating into the housing 3 and blocking the nozzles 11. If a portion of the nozzles 11 are not being used, for example if only three-quarters of the width of the cylinder 2 is printing, the slides or covers 21 can be moved in front of the unused nozzles 11.

Figure 7:
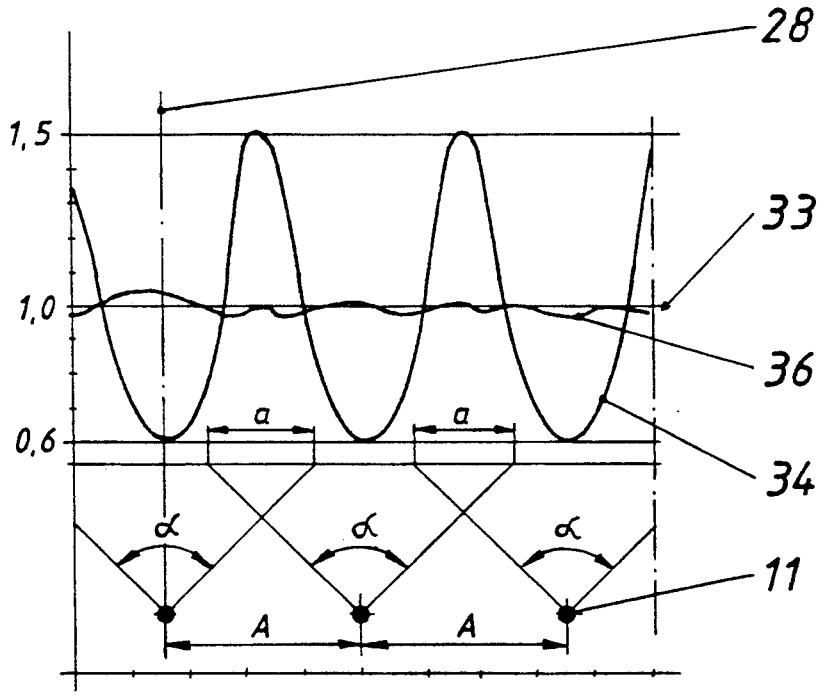
FIG. 7 is a diagrammatic view of the moisture distribution over a plurality of spray areas.

Referring now to FIG. 7, there is presented a schematic depiction of the moisture distribution caused by a plurality of spray nozzles 11, each having a spray area $\alpha$. This plurality of spray nozzles 11 are positioned adjacent each other axially along the length of a cylinder 2 to be moistened. The upper portion of FIG. 7 depicts an ideal, even moisture distribution curve, which is assigned a factor 1, in the shape of a straight line 33. The curve 34 shows the moisture distribution of a non-smoothed spray 10 without screen plates 12 and 13, as indicated in FIG. 1. It can be seen here that with the disposition of a plurality of fan spray nozzles 11 next to each other, a "moisture distribution factor" of 1.5 is achieved in the overlapping areas a of the spray areas $\alpha$, while in the direction of the centerline 28 of the nozzles 11 a lower moisture distribution factor of 0.6 is achieved. Finally, the curve 36 shows the form of the moisture distribution factor when screen plates 12 and 13 of the present invention are utilized. This factor remains around 1.0, i.e. close to the ideal moisture distribution factor. This means that the cylinder moistening assembly of the present invention is effective in providing a nearly uniform moistening fluid distribution along the length of the cylinder 2.

Figure 8:
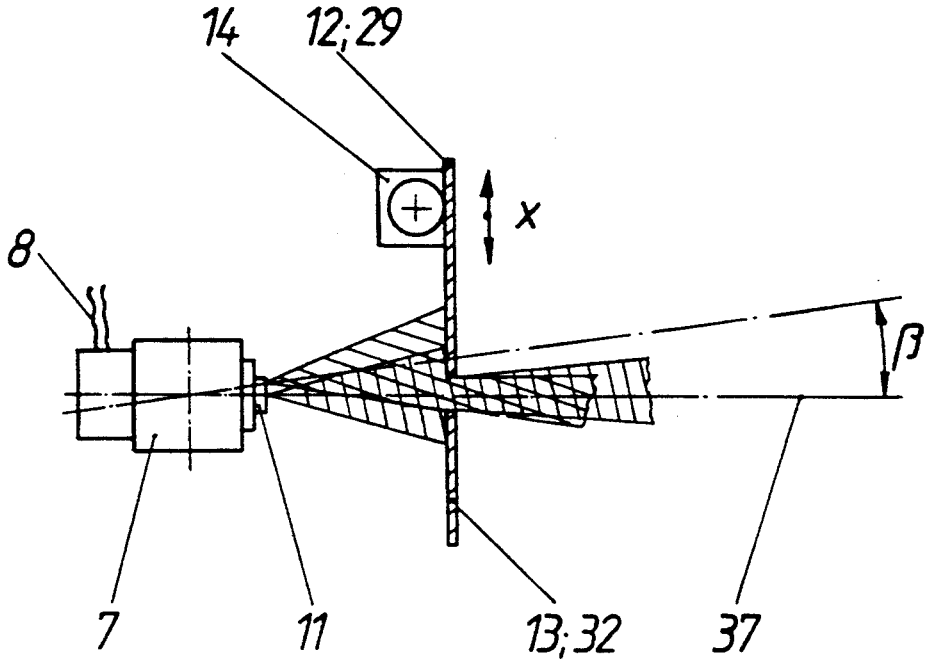
FIG. 8 is a side view, partly in cross-section of a fan spray nozzle device which is pivotable about a horizontal line.

Referring now to FIG. 8, there is shown a side elevation view of a second preferred embodiment of the cylinder moistening assembly 1 of the present invention but without the housing 3. In this second preferred embodiment, the fan spray nozzle device 7 with the nozzle 11 is pivotable around an adjusting angle $\beta$ of 0° to 45° with respect to the horizontal 37. In this case the upper screen plate can be embodied as screen plate 12 or screen plate 29 and the lower screen plate as screen plate 13 or screen plate 32 in accordance with FIGS. 2 to 6. The upper screen plate can be operated in the direction X via a servo motor 14, analogous to FIG. 1. The lower screen plate 13 or 32 is embodied to be a stationary plate.

Figure 9:
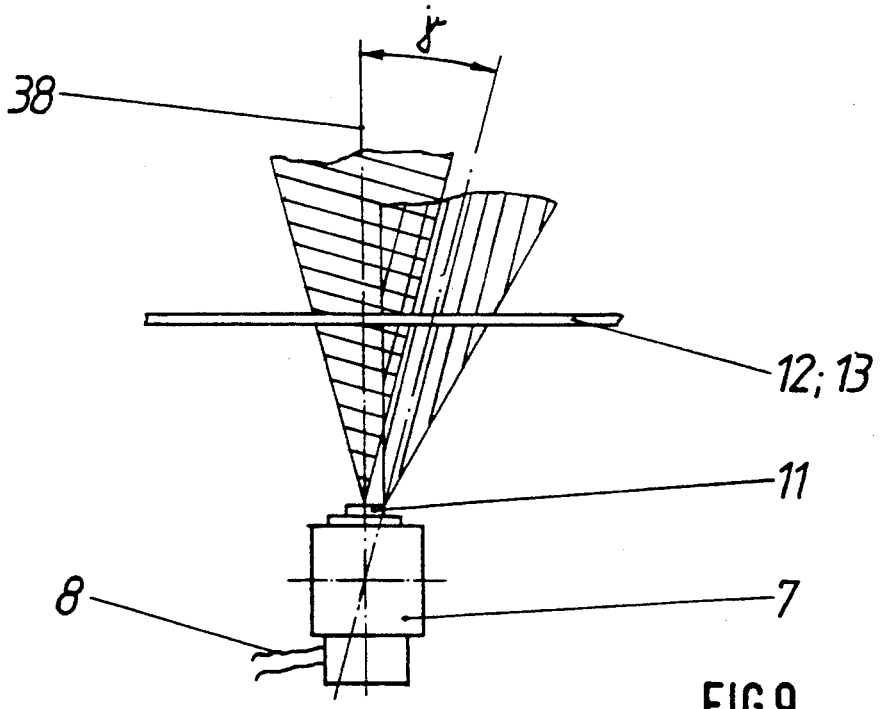
FIG. 9 is a top plan view of a fan spray nozzle device pivotable about a perpendicular plane.

In a third preferred embodiment of the cylinder moistening assembly 1, as depicted in the top plan view shown in FIG. 9, and in which the housing 3 has again been omitted, the fan spray nozzle device 7 with the spray nozzle 11 is pivotable about an adjusting angle $\gamma$ of 0° to 45° with respect to a vertical plane 38. In this embodiment, the upper and lower screen plates 12 and 13 are structured as the two moveable screen plates 12 and 13 of FIG. 1 and are thus both movable in the direction "X". as also indicated in FIG. 1.

Figure 10:
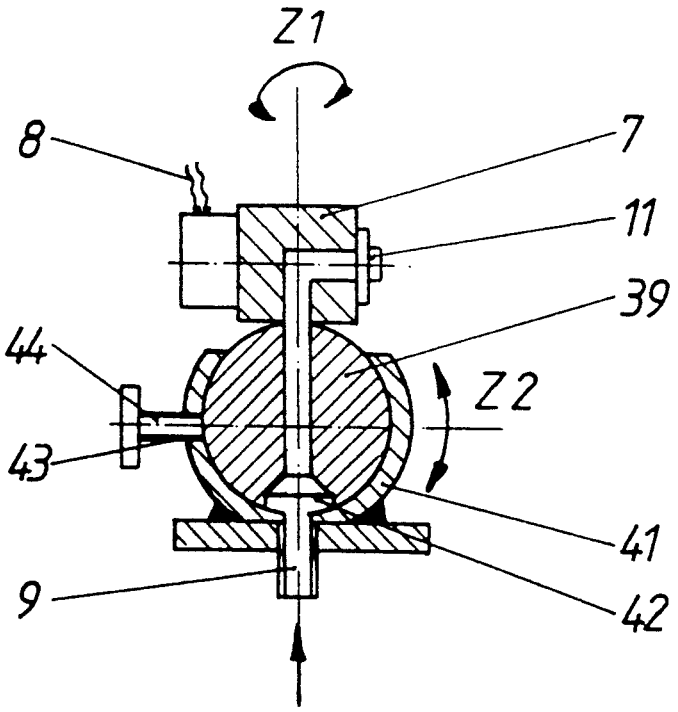
FIG. 10 is a cross-sectional view of a spray nozzle usable in the fan spray nozzle device of the present invention.

Referring now to FIG. 10, there may be seen a detailed cross-sectional view of a pivotable spray nozzle 11 which may be used in the second and third preferred embodiments of the cylinder moistening assembly depicted in FIGS. 8 and 9. In contrast to the spray nozzle 11 shown in FIG. 1, this spray nozzle 11 which is usable in the devices of FIGS. 8 and 9, is supported by a ball joint that includes a ball 39 which is supported in a ball socket 41. A supply line 9 for the moistening fluid is in fluid communication with an enlarged, truncated cone-shaped first end of the fluid supply passage in the ball 39. This will insure a sufficient supply of dampening fluid through the ball 39 to the spray nozzle 11 during the movement of the ball 39 in its socket 41. The position of the spray nozzle 11 carried by the ball 39 can be held in a desired position by use of a locking screw 44 which is received in a threaded bore 43 in the ball socket 41 and which upon tightening will engage the side of the ball 39. The nozzle 11 can move in both directions 71 and 72, as depicted in FIG. 10 and these two motions can be combined so that the nozzles 11 can be adjusted in three planes thereby allowing the inclusion of the adjusting angles $\beta$ and $\gamma$ of FIGS. 8 and 9.

While preferred embodiments of a cylinder moistening assembly in accordance with the present invention have been set forth fully and completely hereinabove, it will be apparent to one of skill in the art that a number of changes in, for example the size of the cylinder or cylinders being moistened, the specific type of dampening fluid being used, the type of frame of the offset rotary printing machine and the like can be made without departing from the true spirit and scope of the present invention which is accordingly to be limited only by the following claims.

What is claimed is:

1. A cylinder moistening assembly useable to moisten a cylinder of an offset rotary printing press, said cylinder moistening assembly comprising:

a printing press including a cylinder to be moistened;

a housing secured to said printing press and adjacent said cylinder to be moistened;

a plurality of fan spray nozzle devices positioned in said housing and disposed axially adjacent each other, said plurality of fan spray nozzle devices being usable to direct a moistening fluid toward said cylinder;

a spray nozzle in each of said fan spray nozzle devices, each of said spray nozzles producing a spray of said moistening fluid directed in a spray path toward said cylinder and having a spray area, portions of said moistening fluid spray areas for adjacent ones of said spray nozzles overlapping and forming an uneven, non-smoothed moistening fluid spray; and a screen assembly interposed in said housing in said spray path between said spray nozzles and said cylinder to be moistened, said screen assembly including movable upper and lower spaced screen plates having adjacent upper and lower edges shaped to form a shaped spray outline in said spray areas of said spray nozzles, said spray of moistening fluid contacting said screen assembly and passing through said shaped spray outline to form a smooth, even shaped spray of said moistening fluid for even distribution over a surface of said cylinder being moistened.

2. The cylinder moistening assembly of claim 1 wherein said spray outline is irregular.

3. The cylinder moistening assembly of claim 2 wherein said edges of at least one of said upper and lower screen plates are rising and falling in a step-like manner.

4. The cylinder moistening assembly of claim 1 further including upper and lower servo motors secured to said housing wherein said upper and lower screen plates are adjustable by said upper and lower servo motors.

5. The cylinder moistening assembly of claim 1 further including means to provide a positive air pressure in said housing.

6. The cylinder moistening assembly of claim 5 wherein said means includes a compressed air supply line.

7. The cylinder moistening assembly of claim 1 further including a slide secured to said housing and wherein at least two adjacent ones of said spray nozzles can be covered by said slide.

8. The cylinder moistening assembly of claim 7 further including a servo motor secured to said housing wherein said slide is movable by said servo motor.

9. The cylinder assembly of claim 1 wherein said spray area of each of said spray nozzles is between 40° and 150°.

* * * * *